United States Patent [19]

Pervier et al.

[11] 4,411,677

[45] Oct. 25, 1983

[54] NITROGEN REJECTION FROM NATURAL GAS

[75] Inventors: James W. Pervier, West Chester; Harvey L. Vines, Emmaus; Vincent Marano, III, Macungie; Michael A. Patterson, Whitehall, all of Pa.

[73] Assignee: Air Products and Chemicals, Inc., Allentown, Pa.

[21] Appl. No.: 376,365

[22] Filed: May 10, 1982

[51] Int. Cl.[3] ..... F25J 3/02

[52] U.S. Cl. ..... 62/25; 62/29; 62/33; 62/34; 62/40

[58] Field of Search ..... 62/40, 9, 11, 23, 24, 62/27, 28, 29, 30, 31, 32–34, 42, 44, 25

[56] References Cited

U.S. PATENT DOCUMENTS 3,238,735 3/1966 Siewart ..... 62/28

3,797,261 3/1974 Juncker et al. ..... 62/40

OTHER PUBLICATIONS

Linde Reports on Science and Technology 15/1970, pp. 51–52.

*Primary Examiner*—Frank Sever

*Attorney, Agent, or Firm*—Geoffrey L. Chase; E. Eugene Innis; James C. Simmons

[57] ABSTRACT

A process is disclosed for rejecting nitrogen from a natural gas feed containing nitrogen over a wide range of compositions, e.g. 5–85% nitrogen by volume, under elevated pressure using a single distillation column and a closed loop methane heat pump which reboils and refluxes the column. An intermediate reflux condenser is refrigerated by both the heat pump and overhead nitrogen fraction from the distillation column. The process can handle feeds with increasing nitrogen content and more than 100 ppmv carbon dioxide. The feed can be at pipeline pressure with the natural gas liquid components still present or at lower pressure with natural gas liquids removed. A mixed cryogenic refrigerant can be used in the heat pump as an alternative to methane. The process provides a high methane recovery over the entire feed range, and provides a nitrogen product stream having an elevated pressure suitable for recycling and reinjection to an oil or gas well to improve well head pressure.

8 Claims, 1 Drawing Figure

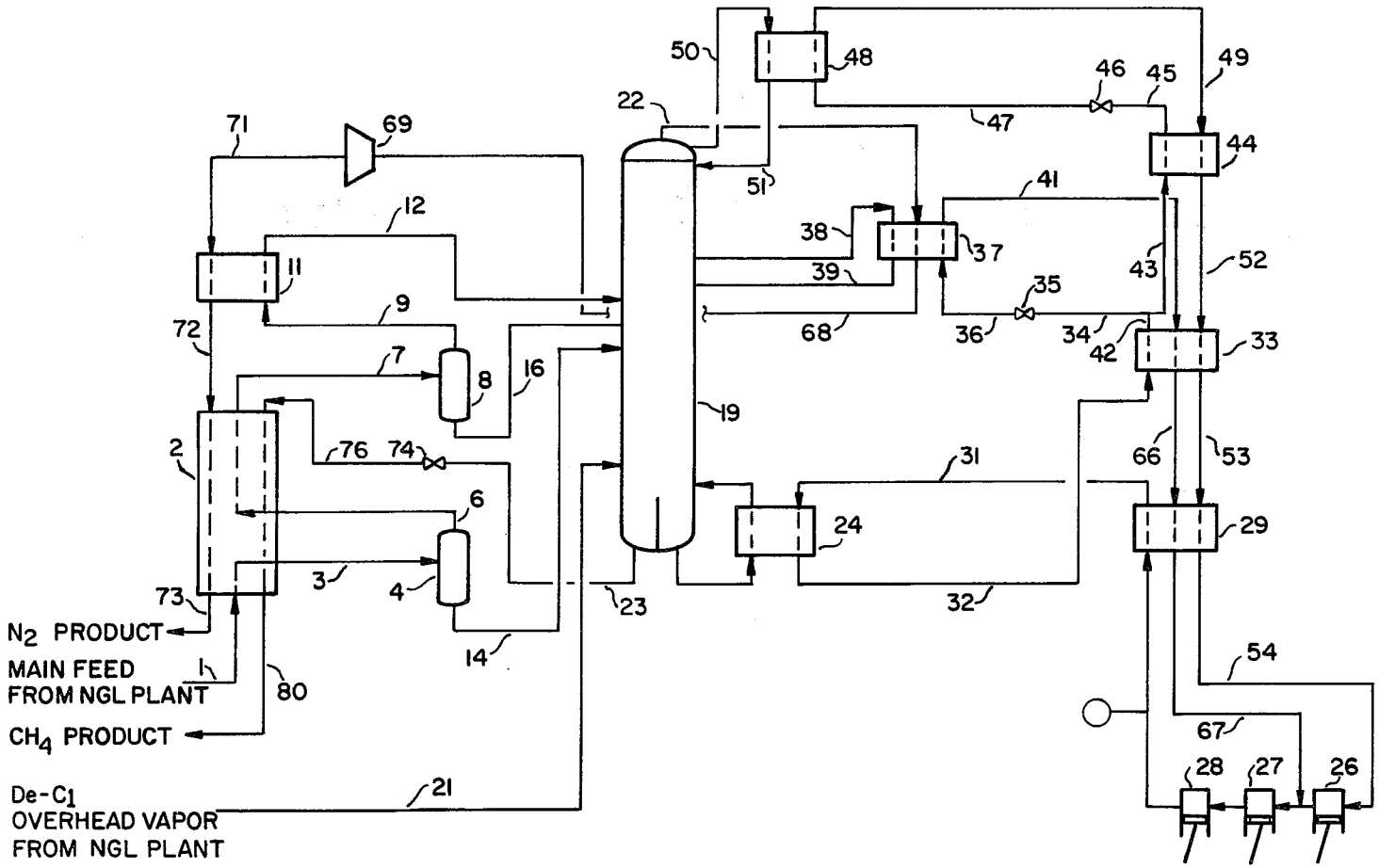
N2 PRODUCT
MAIN FEED FROM NGL PLANT
CH4 PRODUCT
De-C1 OVERHEAD VAPOR FROM NGL PLANT

NITROGEN REJECTION FROM NATURAL GAS

BACKGROUND OF THE INVENTION

This invention relates to the separation of nitrogen from a natural gas containing nitrogen over a wide concentration range to form nitrogen and natural gas product streams under elevated pressure without incorporating means for recompression of the separated products.

Petroleum production methods currently are utilizing high pressure nitrogen injection to maintain well head pressure for enhanced oil and gas recovery. As nitrogen is injected, the natural gas from the well containing methane and associated hydrocarbon liquids also contains nitrogen which increases in amounts over the life of the nitrogen injection project. For this reason, the natural gas containing nitrogen must be separated to reject the nitrogen and to form purified natural gas feedstocks suitable for utilization as fuel or chemical feedstocks.

U.S. Pat. No. 3,797,261 discloses the separation of natural gas containing nitrogen into a low-nitrogen fraction and a high-nitrogen fraction by distillation in a single distillation column by expanding the high nitrogen fraction with the performance of work and using the resulting refrigeration to condense vapor in the upper section of the column while additional reflux is provided by vaporizing a recycle medium in heat exchange relation with vapor in the column. The high nitrogen mixture, having been expanded, is exhausted at atmospheric pressure.

Linde Reports On Science And Technology 15/1970, pp. 51–52, shows a process for separating nitrogen from natural gas containing a fixed nitrogen content, i.e., 15% nitrogen. A methane cycle, operating on the principal of the heat pump, is utilized in the process to provide the refrigeration. The overhead nitrogen fraction from the distillation column is depicted as a supplemental means to subcool the methane prior to methane expansion to provide refrigeration to the column.

In a nitrogen injection process to maintain well head pressure, the extracted gas increases in nitrogen content such that natural gas from the well can contain nitrogen over a wide range of concentration, e.g., generally from 5 to 85%. Conventional processes are limited in ability and may be ineffective for separating nitrogen from natural gas over such a wide range of nitrogen content to produce nitrogen and natural gas product streams under elevated pressure. Further, conventional processes for separating nitrogen from natural gas containing nitrogen and having a significant carbon dioxide content are restricted by carbon dioxide freezing or solidifying in the process equipment.

SUMMARY OF THE INVENTION

The process of the present invention provides a system for separating nitrogen from a high pressure feed containing natural gas and nitrogen over a wide concentration range in a single distillation column to form a high pressure product stream of nitrogen and a high pressure product stream of natural gas by cooling the high pressure feed with subsequent separation in a single distillation column to form a high pressure overhead vapor rich in nitrogen and a high pressure bottoms liquid rich in natural gas hydrocarbons. The process of the invention condenses a head vapor of an upper section of the distillation column by heat exchange with a first closed loop refrigerant to provide reflux to the column, condenses an intermediate vapor of an intermediate section of the column by heat exchange with a second closed loop refrigerant and by heat exchange with the high pressure overhead vapor rich in nitrogen to provide an intermediate reflux to the column, such that the intermediate section vapor condensing duty attributable to the heat exchange against the high pressure nitrogen overhead increases with increasing nitrogen content in the feed to the process. Preferably, the first and second closed loop refrigerants comprise first and second portions of a circulating refrigeration fluid in a closed loop heat pump such that the refrigeration fluid is compressed, cooled in exchange with the bottoms liquid in the distillation column thereby providing reboiler heat to the column, subcooled to a temperature sufficient to form and provide the second closed loop refrigerant, and further subcooled to a temperature sufficient to form and provide the first closed loop refrigerant.

The process of the present invention is capable of separating or rejecting nitrogen from natural gas containing nitrogen over a wide range of nitrogen content, which nitrogen content will increase during the course of a nitrogen injection to a well head, e.g., over a general range of 5 to 85%.

The present invention provides a nitrogen product stream which is rejected at high pressure, decreasing the need for additional compression of the nitrogen which then can be returned under such pressurized condition for use in nitrogen reinjection to the well head. The improved process in this way provides an improved efficiency derived over long nitrogen injection periods which can extend beyond 10 years in a typical oil and gas well.

The improved process will handle greater than 100 parts per million volume (ppmv) carbon dioxide in the feed over the entire feed composition range.

The improved process provides a high methane recovery over the entire feed composition range where the required reflux to perform the separation is provided by the heat pump. The heat pump cycle, as opposed to any cycle that is auto-refrigerated, has the flexibility to provide a specific reflux to the column and thereby provide an economically favorable high methane recovery.

The improved process incorporates an intermediate condenser into the distillation column to provide a second level of reflux warmer than the overhead reflux. The two levels of refrigeration and reflux increase the efficiency of the column and provide a reduced requirement of overall power. The intermediate condenser is operated over the wide range of feed composition in such a way to utilize the overhead nitrogen for refrigeration without expansion by incorporating the heat pump having a subcooled refrigerant fluid flashed to an intermediate pressure.

The improved process incorporates a heat pump fluid of methane, but a mixed cryogenic refrigerant can be used to adapt the cycle efficiently to different feeds and product specifications.

BRIEF DESCRIPTION OF THE DRAWING

The FIGURE is a schematic flow diagram of an embodiment of the invention for a preferred form of separating nitrogen from a natural gas containing nitrogen over a wide concentration range, e.g., 5–85% nitrogen.

DESCRIPTION OF THE PREFERRED EMBODIMENT

Many enhanced oil and gas recovery projects currently employ high pressure nitrogen for reservoir pressure maintenance or miscible flood. In these processes, associated gas from the well becomes diluted by increasingly larger amounts of nitrogen as the project continues. Nitrogen must be removed, or otherwise the nitrogen content will lower the heating value of the associated gas and make the natural gas unacceptable for chemical feedstocks. The dilution by increasing amounts of nitrogen forms a natural gas having a nitrogen content of from 5–85%. The improved process provides a system for separating or rejecting the nitrogen from this variable composition natural gas over the wide range of compositions experienced throughout the life of the enhanced oil and gas recovery project.

The nitrogen product stream provided from the separation of nitrogen from the natural gas is used for reinjection into the reservoir to maintain pressure of the oil or gas recovery project. The improved process provides a nitrogen product stream at an elevated pressure, e.g. in the vicinity of 200–300 psi, thereby decreasing the need for subsequent recompression of the nitrogen.

The improved process is capable of accommodating carbon dioxide in the feed and prevents carbon dioxide solidification at various stages in the process.

The improved process incorporates a number of improvements in distillation design which produce a decrease in energy consumption. A nearly complete separation of nitrogen and hydrocarbons requires a fractional distillation to be carried out. Distillation is inherently an inefficient unit operation whereby energy is supplied to the reboiler in a distillation column at the highest temperature and removed from the overhead condenser at the lowest temperature with a high degree of irreversibility inherent. The following detailed description of the improved process discloses several preferred embodiments of the improved process to provide an efficient distillation system.

Referring to the FIGURE, a natural gas from an oil reservoir or gas field maintained at pressure by high pressure nitrogen injection enters a natural gas liquids recovery plant, not shown, where the ethane and heavier hydrocarbons are separated as liquids. The natural gas containing nitrogen, which nitrogen content will vary over a wide range during the course of the nitrogen injection project, is fed to the process of the present invention. The natural gas has been expanded, not shown, by the use of a turbo expander from a pressure in the range of 900–1100 psia to a pressure of approximately 400 psia. Two streams are removed from the natural gas liquids plant and are provided to the present process. The principal feed gas enters the present process in line 1 from an expander discharge separator of the natural gas liquids plant and is cooled in the main feed exchanger 2. Cooled principal feed is passed in line 3 to separator 4 where liquid is removed. Vapor from the separator 4 is passed in line 6 for further cooling in main exchanger 2 and is fed in line 7 to separator 8. Vapor from separator 8 is sent in line 9 to cold feed exchanger 11. Cold feed in line 12 and liquid cuts from the separators in lines 14 and 16 are introduced to distillation column 19 at increasingly higher, and accordingly colder, trays of the distillation column. A second gas stream from the natural gas liquids plant enters the present process in line 21 from the demethanizer column, not shown, and is fed to the bottom portion of the distillation column.

A fractionation is performed in distillation column 19, overhead vapor product comprising a vapor rich in nitrogen is removed in line 22, and a bottoms liquid stream comprising liquefied natural gas and heavier hydrocarbons is removed in stream 23. The reboiler duty for the fractionation column is provided by reboiler 24.

An external heat pump system is employed having compressors 26, 27, and 28 for the compression of nearly pure methane which is used as the heat pump circulating fluid. Compressed methane exiting compressor 28 is passed to gas heat exchanger 29 and is therein cooled. Cold compressed methane is passed in line 31 to reboiler 24 to provide reboiler heat through heat exchange in reboiler 24 wherein the compressed methane is totally condensed. Liquid methane exiting the reboiler in stream 32 is subcooled in warm subcooler 33. Subcooled liquid methane in line 42 is split into two streams in lines 34 and 43. Subcooled methane in line 34 is flashed at 35 to an intermediate pressure and is passed in line 36 to be revaporized in side condenser 37 to provide intermediate reflux in the fractionation column by cooling an intermediate fraction withdrawn from the column in line 38 and cooled in side condenser 37 to form a liquid stream in line 39 which is introduced back to distillation column 19 as reflux. The intermediate reflux provided by side condenser 37 alternatively can be provided by heat exchange directly within column 19 in lieu of side condenser 37 as depicted external to the column in the presennt FIGURE. The intermediate reflux is provided at a point between the overhead condenser and the highest feed to the column. After being vaporized in the side condenser, methane at an intermediate pressure exits condenser 37 in line 41. Subcooled methane in line 43 is further subcooled in cold subcooler 44 and is passed in line 45 to the coldest part of the plant where it is flashed at 46 and fed in line 47 to overhead condenser 48 where the methane is revaporized and exits the condenser in line 49. The overhead condenser 48 provides condensing duty for a head vapor from the distillation column in line 50 which becomes reflux to the column in line 51. Low pressure vapor in line 49 is returned through cold subcooler 44 and further in line 52 to warm subcooler exchanger 33 and further is passed in line 53 to gas-gas exchanger 29 prior to being returned in line 54 to the beginning of the recompression stage in compressor 26. The methane from side condenser 37, i.e., in line 41 is rewarmed through the warm subcooler 33 and is passed in line 66 to gas-gas exchanger 29 prior to return in line 67 to the compression stage at an intermediate position, i.e., for introduction to compressor 27.

High pressure nitrogen from the overhead of the fractionation column in line 22 is sent through side condenser 37 where sensible refrigeration duty from the overhead nitrogen is recovered in the form of intermediate reflux for use in intermediate stage of the column. High pressure nitrogen in line 68 can be expanded to about 250 psia in expander 69 to provide extra refrigeration as desired from the nitrogen which is sent in line 71 through cold feed exchanger 11 and further through line 72 to main feed exchanger 2 where final refrigeration recovery from the cold nitrogen occurs. Product nitrogen at an elevated pressure exits the main feed exchanger 2 in line 73 and can be rewarmed in the NGL plant prior to being returned to the nitrogen injection project at the well head.

Hydrocarbon products from the bottom of the fractionation column in line 23 are flashed at 74 and sent in line 76 to main exchanger 2 to provide condensing duty for the feed. Product methane removed in line 80 can be returned to the NGL plant and rewarmed therein.

The process as described above represents a scheme for performing the process of the present invention when a natural gas liquids plant must be accommodated. An alternative embodiment wherein the natural gas feed to the process of the present invention is at ambient temperature and contains natural gas liquids provides a feed to the process at 900 to 1100 psia. Differences in the process to accommodate a high pressure feed are in the front end refrigeration requirements for the feed gas. Because more refrigeration potential exists in the feed gas for the reason that the feed gas has not been expanded previously to a lower pressure for natural gas liquids recovery, it is not necessary to expand the overhead nitrogen after it leaves the side condenser. Therefore, the overhead nitrogen at a high pressure is rewarmed in the cold feed exchanger 11 and the main feed exchanger 2 and is recovered in line 73 as a higher pressure product nitrogen at approximately 350 psia. When the feed gas has not undergone natural gas liquids recovery, the hydrocarbon product from the bottom of the fractionation column can be split into two fractions, such that the first fraction is flashed to a lower pressure, is revaporized in main feed exchanger 2 and a preliminary warm feed exchanger, not shown, and is recovered as a low to medium pressure product. The second fraction of the hydrocarbon product is pumped to pipeline pressure and revaporized in main feed exchanger 2. In this embodiment, the second fraction of the hydrocarbon product does not require any further compression in order to be sent to pipeline distribution.

The improved process, either with or without natural gas liquids recovery, employs multiple feeds to the fractionation column to reduce the amount of reflux and reboil in the column. The FIGURE depicts a system having a number of separators which are part of the preferred embodiment, but nevertheless, the process of the present invention may be carried out with fewer feed separators. The process as depicted in the FIGURE generally is suitable for natural gas streams with or without natural gas liquids recovery wherein the pressure is at 350 psi or greater for feed into the process of the present invention. The preferred range of distillation in the fractionation tower is 300–400 psi. Fractionation above 400 psi will approach the critical region limitations on nitrogen and for that reason is not practical.

The product methane derived from the improved process contains concentrations of nitrogen typically in the range of from 1–3% by volume, and typical hydrocarbon recovery is in excess of 99.5%.

Additionally, the high pressure distillation process has the added advantage of handling significant quantities of carbon dioxide, i.e., 100 ppmv or higher, without solidification of carbon dioxide in the equipment. The amount of carbon dioxide which can be accommodated in the process of the present invention will vary depending on the feed composition and can be as high as 1% by volume at low nitrogen compositions in the feed.

What is claimed is:

1. A process for separating nitrogen from a high pressure feed containing natural gas and nitrogen over a wide concentration range of 5–85% by volume in a single distillation column to form high pressure product streams of nitrogen and of natural gas comprising:

(a) cooling said high pressure feed against high pressure product streams to separate multiple feeds to said column and distilling said cooled feeds in said single distillation column to form a high pressure overhead vapor rich in nitrogen and a high pressure bottoms liquid rich in natural gas hydrocarbons;

(b) condensing a head vapor of an upper section of said column by heat exchange with a first closed loop refrigerant to provide reflux to said column;

(c) condensing an intermediate vapor of an intermediate section of said column by heat exchange with a second closed loop refrigerant and by heat exchange with said high pressure overhead vapor rich in nitrogen without expansion to provide an intermediate reflux to said column, wherein said intermediate section vapor condensing attributable to heat exchange with said high pressure nitrogen overhead increases with increasing nitrogen concentration in said feed.

2. A process according to claim 1 wherein said product stream nitrogen is reinjected into an oil or gas well to improve well head pressure.

3. In a process for separating nitrogen from a high pressure feed containing natural gas and nitrogen consisting of cooling said high pressure feed and distilling the cooled feed in a single distillation column to form a high pressure overhead vapor rich in nitrogen and a high pressure bottoms liquid rich in natural gas hydrocarbons, the improvement for accommodating a wide concentration range of nitrogen of 5–85% by volume in said feed and forming a high pressure product stream of nitrogen suitable for reinjection to maintain a well head pressure for enhanced oil or gas recovery comprising:

(a) cooling said high pressure feed against high pressure product streams to separate multiple feeds to said column;

(b) condensing a head vapor of an upper section of said column by heat exchange with a first closed loop refrigerant to provide reflux to said column; and (c) condensing an intermediate vapor of an intermediate section of said column by heat exchange with a second closed loop refrigerant and by heat exchange with said high pressure overhead vapor rich in nitrogen without expansion to provide an intermediate reflux to said column, wherein said intermediate section vapor condensing attributable to heat exchange with said high pressure nitrogen overhead increases with increasing nitrogen concentration in said feed.

4. A process according to claims 1 or 3 wherein said first and second closed loop refrigerants comprise first and second portions of a circulating refrigeration fluid in a closed loop heat pump wherein said refrigeration fluid is compressed; cooled; condensed in heat exchange with the bottoms in said column, thereby providing reboiler heat to said column; subcooled to a temperature sufficient to form said second closed loop refrigerant; and further subcooled to a temperature sufficient to form said first closed refrigerant.

5. The process according to claim 4 wherein said feed cooling comprises cooling in a first portion of a main feed exchanger against said high pressure product streams to form a two-phase first feed stream; phase separating the condensed portion of said cooled first feed vapor stream in a first feed separator to form a second feed liquid stream and a second feed vapor stream; cooling said second feed vapor stream in a cold feed exchanger to condense a portion thereof; separating said condensed portion of said second feed vapor stream in a second feed separator to form a third feed liquid stream and a third feed vapor stream; cooling said third feed vapor stream; and introducing said second and third feed liquid streams and said third feed vapor stream to said single distillation column at increasingly colder sections, respectively.

6. A process according to claim 5 wherein said feed contains carbon dioxide in an amount greater than 100 parts per million volume.

7. A process according to claim 6 wherein said circulating fluid comprises methane.

8. A process according to claim 6 wherein said circulating heat pump fluid comprises a mixed cryogenic refrigerant.

* * * * *